US006006867A

United States Patent [19]

Richter et al.

[11] Patent Number: 6,006,867

[45] Date of Patent: Dec. 28, 1999

[54] ELEVATOR GUIDE APPARATUS

[75] Inventors: Utz Richter, Ebikon; Christoph Liebetrau, Menziken, both of Switzerland; Albrecht Morlok, Horb; Jürgen Mahncke, Tiefenbronn, both of Germany

[73] Assignee: Inventio AG, Hergiswil NW, Switzerland

[21] Appl. No.: 08/752,555

[22] Filed: Nov. 21, 1996

[30] Foreign Application Priority Data

Nov. 22, 1995 [CH] Switzerland ..... 3302/95

[51] Int. Cl.[6] ..... B66B 7/04; B66B 5/16

[52] U.S. Cl. ..... 187/410; 187/406; 187/371

[58] Field of Search ..... 187/406, 408, 187/410, 367, 370, 371

[56] References Cited

U.S. PATENT DOCUMENTS

| | | | |
|---|---|---|---|
| 1,566,490 | 12/1925 | Lindquist | 187/409 |
| 1,854,976 | 4/1932 | Brady | 187/410 |
| 1,873,828 | 8/1932 | Dunlop | 187/370 |
| 2,498,299 | 2/1950 | Rissler | 187/406 |
| 3,329,240 | 7/1967 | Harwood et al. | 187/410 |
| 3,517,775 | 6/1970 | Meyer | 187/410 |
| 3,856,117 | 12/1974 | Solymos | 187/406 |
| 5,159,995 | 11/1992 | Sissala et al. . | |
| 5,301,773 | 4/1994 | Jamieson et al. . | |
| 5,366,044 | 11/1994 | Jamieson et al. | 187/359 |
| 5,544,722 | 8/1996 | Mckenzie | 187/410 |
| 5,632,358 | 5/1997 | Maeda et al. | 187/410 |

FOREIGN PATENT DOCUMENTS

| | | | |
|---|---|---|---|
| 5-338956 | 12/1993 | Japan | 187/410 |
| 386651 | 4/1965 | Switzerland . | |
| 929528 | 5/1982 | U.S.S.R. | 187/410 |
| 220227 | 8/1924 | United Kingdom | 187/410 |
| 848964 | 9/1960 | United Kingdom | 187/410 |

*Primary Examiner*—David A. Bucci
*Assistant Examiner*—Thuy V. Tran
*Attorney, Agent, or Firm*—MacMillan, Sobanski & Todd, LLC

[57] ABSTRACT

A guide apparatus for guiding and arresting an elevator running on column-like guides automatically prevents a transmission of guide alignment errors to the car and an unintended engagement of the arresting device. A roller carrier for engaging the guide running surfaces is rotationally movably mounted on the car with a center of rotation at the longitudinal axis of the guide so that the roller carrier can follow a twist of the guide about its axis. The roller carrier also mounts an arresting device which is vertically displaceable in a mounting bracket by contact with a buffer on an abutment attached to the elevator car. In the case of an arresting braking of the car, no force is transmitted to the guide apparatus.

17 Claims, 3 Drawing Sheets

ELEVATOR GUIDE APPARATUS

BACKGROUND OF THE INVENTION

The present invention relates generally to an apparatus for guiding elevator cars and, in particular, to an apparatus for preventing transmission of guide alignment errors and an unintended engagement of the car arresting device.

Guide alignment errors usually are horizontal deviations from a vertical line generally parallel to the path of travel of an elevator car. In the case of column-like guides formed by extruded profiles, another type of alignment error can arise. Due to the manufacturing method, in particular for guide lengths of, for example, 5 to 6 meters, slight twists of a few degrees of angle about the guide axis are difficult to avoid. In consequence of the high stiffness and under consideration of the mode of installation used for this type of guide, it is not possible to reverse such a twist. It follows that elevator car guide devices for this type of guide must have a certain mobility in order to be able to accurately follow the guide path.

The Swiss Patent No. 386 651 shows a slide guide shoe which is carried in a ball socket and, due to this manner of mounting, has additional degrees of freedom for adaptation movements along a twisted guide path.

However, the principle of mounting by means of ball socket is not usable for guide rollers which encompass a column-like guide because the center of rotation of the car mounted guide equipment lies outside the guide cross-section and because this form of mounting has too many degrees of freedom for tracking movements for per se absolutely straight guides.

For the engagement of a conventional arresting device mounted on an elevator car, column-like guides include a projecting vertically extending brake leg. In the case of twist errors of the guide about its longitudinal axis, the leg could contact the arresting device and thus cause an unintended engagement of the same. To provide a greater air gap between an arresting device brake wedge and a brake surface on the guide as a countermeasure to unintended engagement is only conditionally possible due to the limited brake wedge travel and thus only partially solves the problem.

The U.S. Pat. No. 5,159,995 shows an elevator car wedge arresting device with two guide rollers. The two sprung guide rollers are firmly connected with the arresting device and have a limited spring travel which is less than the air gap between the brake wedge and the brake surface on the guide.

With this equipment, the air gap between the brake wedge and the brake surface must be dimensioned to be relatively large, because the spring travel of the guide rollers must be accommodated therein. An undesired reaction delay upon the triggering of the arresting device always results from this configuration. Moreover, a new arresting device must be constructed or an existing one rebuilt expensively.

SUMMARY OF THE INVENTION

The present invention concerns an apparatus for guiding an elevator car along a pair of column-like guides. The elevator car has a yoke attached thereto. The guide apparatus is arranged in a horizontal plane for movement about a center of rotation at the longitudinal axis of the guide cross-section and carries a conventional car arresting device. The guide apparatus includes a roller carrier means having rotatably mounted roller guides for engaging a plurality of running surfaces on the guides and a mounting means movably connected to the roller carrier means and mounted on the yoke. When the roller guides engage the running surfaces on the guides, the mounting means permits movement of the roller carrier means relative to the elevator car along a generally horizontal path centered at a longitudinal axis of the guides to maintain the roller guides in alignment with the running surfaces during twisting of the guides about the longitudinal axes. An arresting device mounted on the roller carrier means is selectively engagable with the guide for stopping the elevator car and is vertically displaceable relative to the roller carrier means. A buffer is attached to the yoke for engagement by the arresting device during arrested braking.

It is therefore an object of the present invention to provide an elevator car guiding apparatus and arresting device which does not have the above-mentioned disadvantages of the prior art equipment and which tracks running surfaces along a twisted column-like guide by means of a common device.

It is another object, in the case of an arresting braking, to transmit the braking forces directly to the elevator car without action on the guide apparatus.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
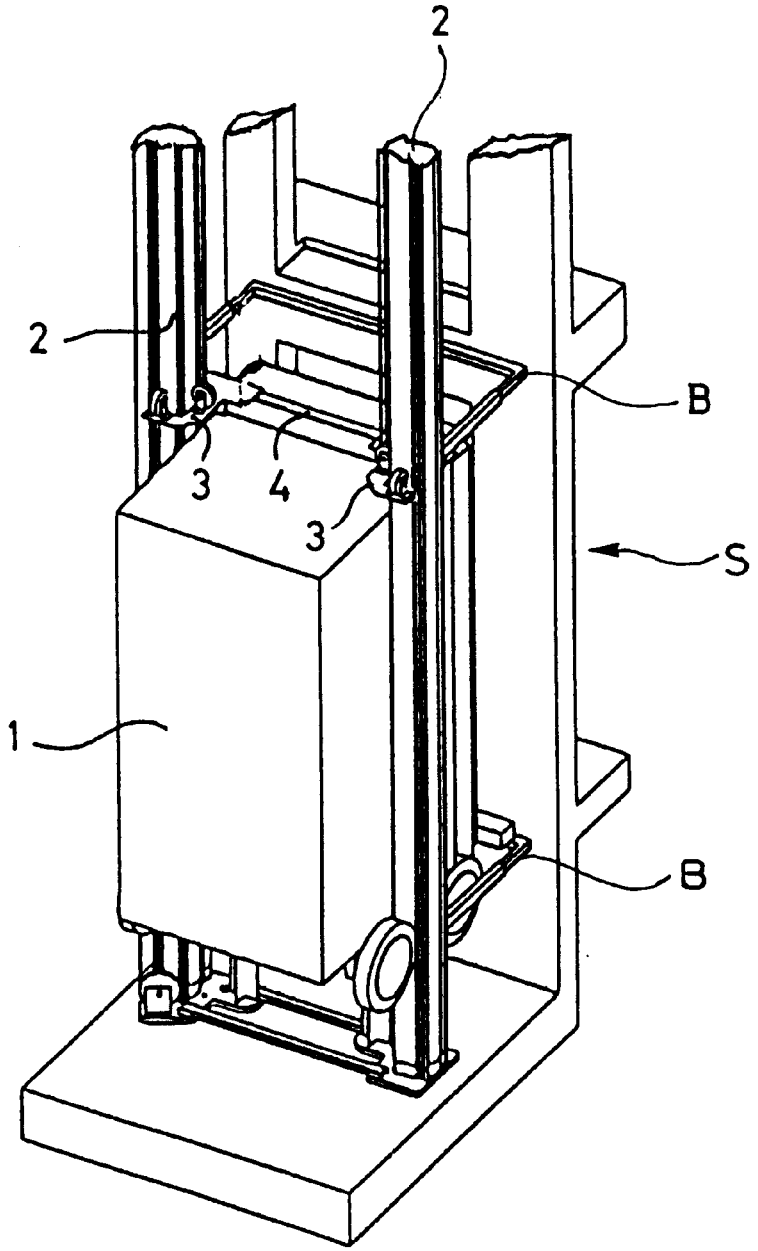
FIG. 1 is a perspective view of a column-guided elevator including a guide apparatus in accordance with the present invention.

There is shown in the FIG. 1 an elevator car 1 running along a pair of spaced apart, generally vertically extending column-like guides 2. The car 1 and the guides 2 are located in an elevator shaft of a structure S, such as a building, and the guides are attached to a wall of the shaft by a plurality of vertically spaced brackets B. A pair of roller guides 3 are mounted at opposite sides of a yoke 4 attached to an upper end of the elevator car 1. The roller guides 3 engage the column-like guides 2 to guide the elevator car 1 along a vertical path of travel in the shaft.

Figure 2:
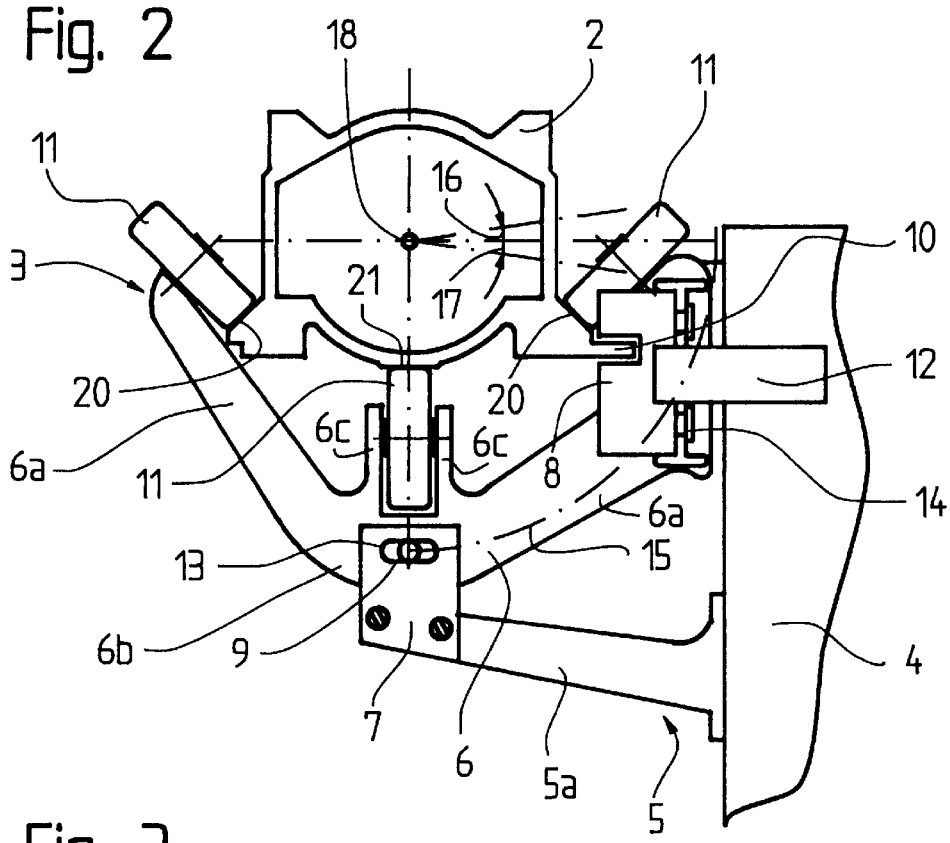
FIG. 2 is top plan view of the guide apparatus shown in the FIG. 1.

The roller guide 3 is shown in more detail in the FIG. 2. The roller guide apparatus 3 includes a generally V-shaped roller carrier means 6 connected to a mounting means 5. The roller carrier means 6 has a pair of legs 6*a* which extend generally horizontally from a central body 6*b*. Each one of a pair of guide rollers 11 is rotatably mounted at an inward side of an associated free end of one of the legs 6*a* such that the axes of rotation of the two guide rollers are at an angle of, for example, approximately 90° to one another. A third guide roller 11, the axis of rotation of which extends at approximately a right angle to a longitudinal axis of the yoke 4, is rotatably mounted between two short fork legs 6*c* extending toward the guide 2 from the central body 6*b* of the roller carrier 6. The roller carrier 6 is configured such that the axes of rotation of the three guide rollers 11 are generally located at apexes of a triangular, generally horizontally extending plane transverse to a longitudinal axis of the guide 2.

The roller carrier 6 is connected to the yoke 4 by the mounting means 5 which includes a pair of vertically spaced guide plates 7, which plates each have a relatively short, elongated guide slot 13 formed therein. The guide slots 13 are located on a generally circular path of movement 15 which path has a center lying at a longitudinal axis 18 of the column-like guide 2. The central body 6*b* of the roller carrier 6 extends between the guide plates 7 and is guided in the guide slots 13 by a generally vertically extending guide pin 9 passing through the central body. Opposite ends of the guide pin 9 extend into the guide slots 13 and are movable along the length of the slots. The guide plates 7 are fastened to one end of an arm 5*a* of the mounting means 5 which arm has an opposite end firmly attached to the yoke 4. Thus, the roller carrier means 6 is movable relative to the mounting means 5, the yoke 4 and the elevator car 1.

A mounting bracket 14 is attached to the one of the legs 6*a* adjacent the yoke 4 and supports a conventional arresting device 8. The arresting device 8 is retained in and is displaceable vertically upwardly in the mounting bracket 14. An abutment 12 is firmly attached to the yoke 4 and projects above an upper end face of the arresting device 8. The arresting device 8 engages about a brake leg 10 which is constructed as a vertically extending projecting prolongation from the outer surface of the column-like guide 2. The two lateral guide rollers 11 mounted on the arms 6*a* each run on a respective one of two generally planar running surfaces 20 formed on the outer surface of the guide 2. The middle guide roller 11 runs on a planar running surface 21 which is formed on an outer surface of a rounding wall of the guide 2. The surfaces 20 and 21 are positioned inside the triangle formed by the axes of the guide rollers 11 and each faces and contacts an associated one of the guide rollers such that the roller guide 3 is retained on the guide 2. The column-like guide 2 can rotate or twist about its longitudinal axis 18 in a counterclockwise direction through an angle 16 and in a clockwise direction through an angle 17. Therefore, the guide rollers 11 must be movable about the longitudinal axis 18 of the guide 2 in order to maintain alignment with the running surfaces 20 and 21.

Figure 3:
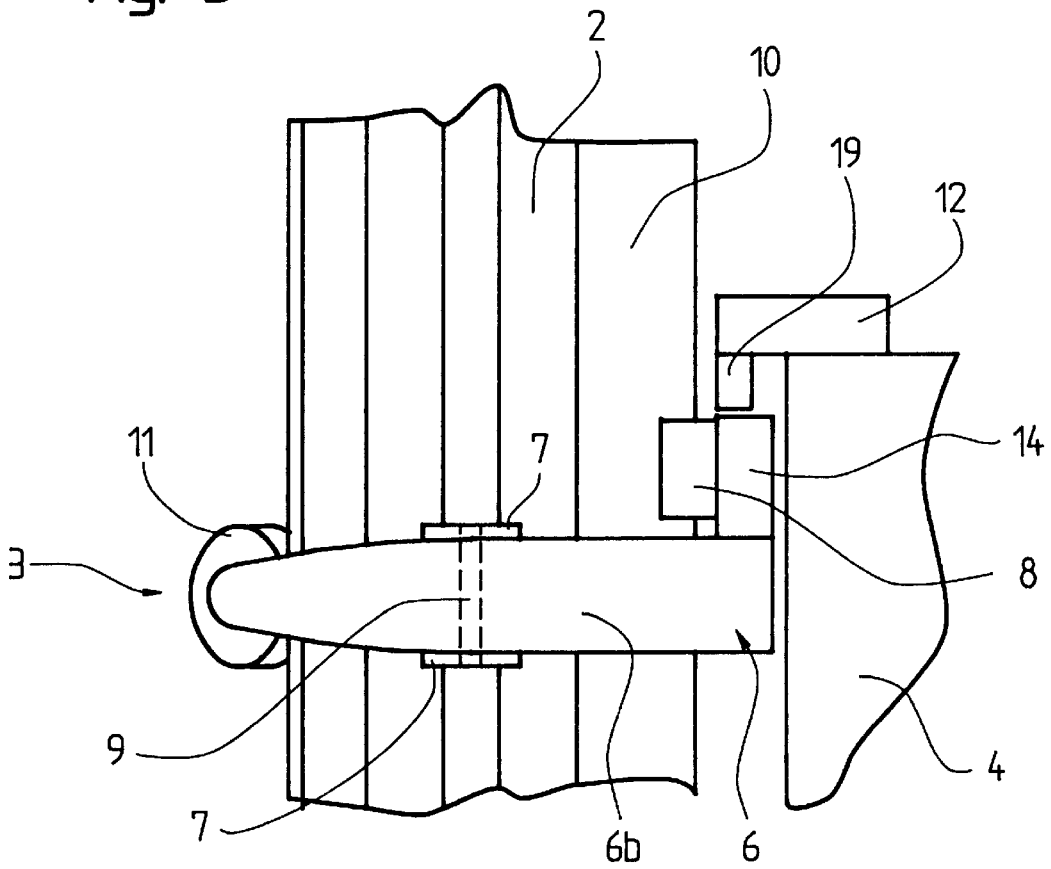
FIG. 3 is a side elevation view of the guide apparatus shown in the FIG. 2 with a portion of the mounting means removed.

The FIG. 3 is a side elevation view of the roller guide apparatus 3, with the arm 5*a* omitted to provide a direct view of the roller carrier means 6. It can be seen how the roller carrier means 6 is guided and retained between the lower and the upper guide plates 7 by the guide pin 9. A buffer 19 can be attached to the abutment 12 adjacent to the mounting bracket 14. In the case of an arresting braking of the elevator car 1 through engagement of the arresting device 8 with the brake leg 10, the suddenly arising high deceleration is transmitted in a damped manner to the elevator car through the buffer 19.

The buffer 19 and the vertical displaceability of the arresting device 8 permit wedge-arresting devices to be used in an increased speed range. Upon the triggering and the coming into effect of the arresting device 8, no force is exerted on the roller guide apparatus 3 because the arresting device drops into its mounting 14 and displaces upwardly to transmit the braking force to the elevator car 1 by way of the buffer 19 and the abutment 12 through the yoke 4.

The extruded profile of the column-like guide 2 can, as mentioned above, exhibit slight twists over its entire length as indicated in somewhat exaggerated manner by the two twist angles 16 and 17. Due to the movable mounting of the roller carrier means 6, which is displaceable in a horizontal plane on the circular movement path 15, the roller carrier means can follow the twists of the column-like guide 2 without transmitting the twist movements to the yoke 4 and the elevator car 1. The center of the path 15 is also the center or the longitudinal axis 18 of the guide 2. The track dimension or spacing between the pair of guides 2 is set accurately during the assembly in the elevator shaft so that the guide apparatus 3 need only absorb the twist errors and the elevator car 1 thus does not experience any undesired lateral movements. The guide slots 13 are so dimensioned that some reserve travel is available beyond the greatest occurring twist of the guides 2.

The guide apparatus 3 described above is a basic solution to the problem of twist about the axis 18 of the guide 2. In a practical application, care is taken to reduce friction during the displacement movement with adequately high stability at the same time. Thus, for example, the guide plates 7 can be spaced horizontally from each other at two positions on the arm 5*a* to serve as a rigid double guide for the roller carrier means 6.

In order to reduce friction without requiring special lubricating equipment, a blocking or canting is prevented by means of appropriate material coupling in the case of the local sliding surfaces. The guidance and mounting of the roller carrier means 6 can, for special cases, be provided by a mounting means including segments of track rolling bearings (not shown), wherein their grooves are formed as circular segments on the path 15.

Figure 4:
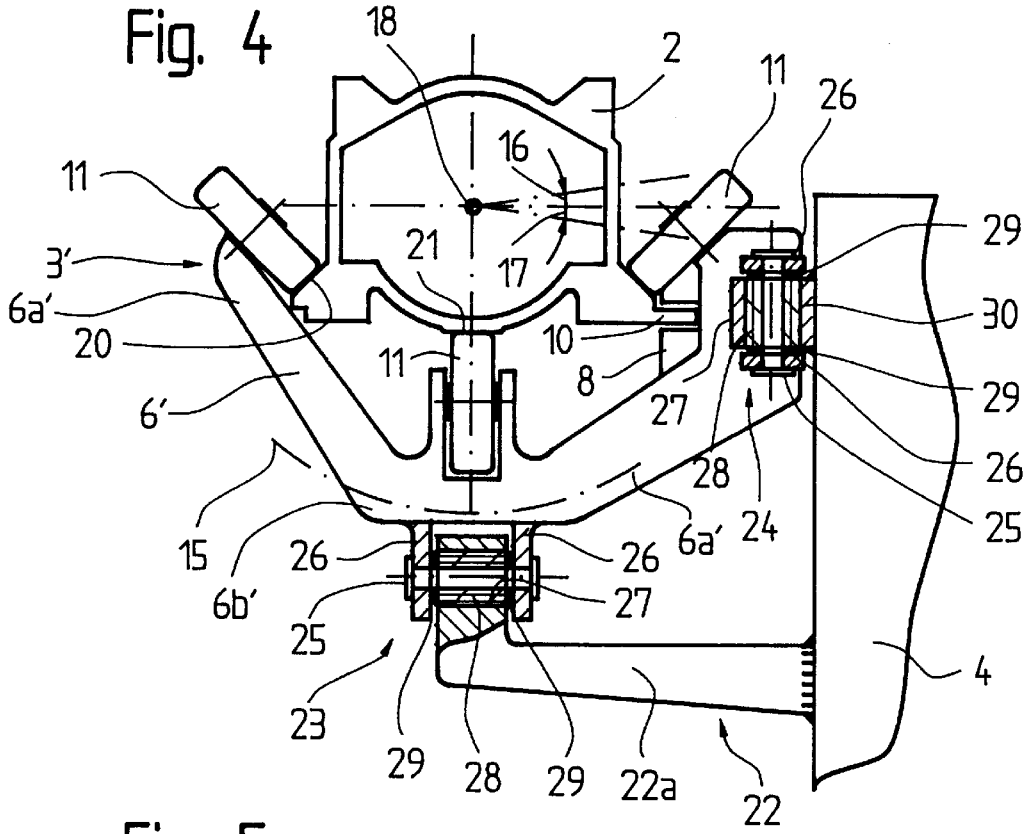
FIG. 4 is a bottom plan view of an alternate embodiment of the guide apparatus shown in the FIG. 2.
Figure 5:
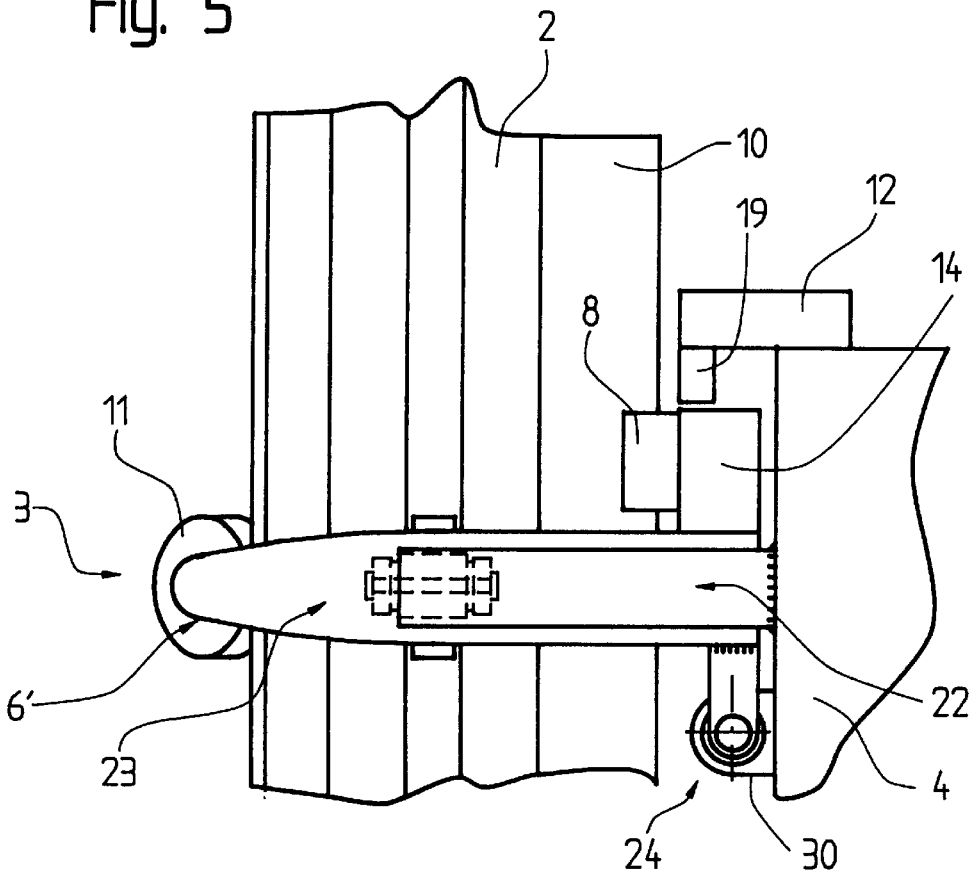
FIG. 5 is a side elevation view of the guide apparatus shown in the FIG. 4.

An alternate embodiment carrier apparatus for a resilient bearing and guidance of the roller carrier means is illustrated in the FIG. 4 and the FIG. 5. In this embodiment, a roller guide 3' includes a roller carrier means 6' which is retained and guided by means of a mounting means 22 including two elastic bearings. A first elastic bearing 23 is attached to a central body 6*b'* of the roller carrier 6' opposite the middle guide roller 11 and at the same height as the rotational axis of the middle guide roller. A second elastic bearing 24 is attached to a leg 6*a'* of the roller carrier 6' adjacent the yoke 4 below and behind the associated guide roller 11. The axes of rotation of the elastic bearings 23 and 24 are arranged at an angle of about 90° to each other but can be in an range of about 45° to 135°. The first elastic bearing 23 is connected to the yoke 4 by an arm 22*a* of the mounting means 22 and the second elastic bearing 24 is connected to the yoke by a bearing mount 30. The elastic bearings 23 and 24 each include a pair of spaced apart bearing legs 26 attached to the roller carrier 6', a bearing pin 25 extending between the bearing legs and forming the bearing axis, a tubular elastic insert 28 through which the bearing pin extends, a bearing bore 27 formed in each of the arm 22*a* and the bearing mount 30 for retaining the bearing pin and the insert, and a pair pressure washers 29 positioned between the end faces of the insert and the bearing legs.

The elastic bearings 23 and 24, or the tubular elastic inserts 28, have a special property in that the hardness transverse to the axial direction is at least twice as great the hardness in axial direction. This property permits the roller carrier means 6', in the plane of the path 15, to follow the possible twists of the column-like guide 2 with small elastic resistance while at the same time providing a damped, but firmer mounting in the vertical direction. The elastic insert 28 with such properties can, for example, consist of a stack of perforated rubber discs which exhibit a sufficient hardness radially and can be elastically deformed axially in the manner of plate springs by a smaller force. It is essential that the pressure washers 29 have a fitting diameter which is smaller than the external diameter of the rubber discs or possibly be formed bowed towards the end face of the elastic insert 28.

The guide apparatus according to the present invention can, for low elevator speeds, be provided with fitting guide slide members (not shown) in place of the guide rollers 11.

In summary, the guide apparatus 3,3' guides the elevator car 1 along the column-like guides 2. The elevator car 1 has the yoke 4 attached thereto. The guide apparatus includes the roller carrier means 6,6' having the rotatably mounted roller guides 11 for engaging the plurality of running surfaces 20,21 on the guides 2 and the mounting means 5,22 movably connected to the roller carrier means and mounted on the yoke. When the roller guides 11 engage the running surfaces 20,21 on the guides 2, the mounting means 5,22 permits movement of the roller carrier means 6,6' relative to the elevator car 1 along the generally horizontal path 15 centered at the longitudinal axis 18 of the guides to maintain the roller guides in alignment with the running surfaces during twisting of the guide about the longitudinal axis. The arresting device 8 mounted on the roller carrier means 6,6' is selectively engagable with the guide 2 for stopping the elevator car 1 and is vertically displaceable relative to the roller carrier means. The buffer 19 is attached to the yoke 4 for engagement by the arresting device 8 during arrested braking.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for guiding elevators comprising:

a roller carrier means for engaging at least one running surface on a column-like guide for an elevator car, the running surface extending generally parallel to a generally vertical longitudinal axis of the guide;

a mounting means movably connected to said roller carrier means; and an arresting device attached to said roller carrier means and being selectively engagable with a brake leg formed on the column-like guide, whereby when said mounting means is mounted on the elevator car and said roller carrier means engages the at least one running surface on the column-like guide, said mounting means permits movement of said roller carrier means relative to the elevator car along a generally circular path centered at and generally transverse to the longitudinal axis of the column-like guide to maintain said roller carrier means in alignment with the running surface during twisting of the column-like guide about the longitudinal axis and prevent an unintended engagement of said arresting device with the brake leg.

2. The apparatus according to claim 1 wherein said roller carrier means includes a central body having a pair of legs extending therefrom and an associated one of a plurality of guide rollers rotatably mounted on each of said central body and said legs for engaging running surfaces on the guide.

3. The apparatus according to claim 2 wherein said guide rollers are positioned to retain said roller carrier means on the guide.

4. The apparatus according to claim 1 wherein said mounting means includes a generally vertically extending guide pin attached to said roller carrier means and having opposite free ends, and a pair of vertically spaced apart generally horizontally extending guide plates, each said guide plate having an elongated slot formed therein for receiving an associated one of said free ends of said guide pin, said slots extending along said generally circular path and said free ends being movable in said slots, said guide plates being fixed relative to the elevator car when said mounting means is mounted on the elevator car.

5. The apparatus according to claim 4 wherein said mounting means includes an arm having one end for attachment to the elevator car and an opposite end attached to said guide plates.

6. The apparatus according to claim 1 wherein said mounting means includes a pair of spaced apart elastic bearings connected to said roller carrier means for mounting on the elevator car.

7. The apparatus according to claim 6 wherein said elastic bearings each have an axis of rotation and said axes of rotation are arranged at an angle relative to each other in an range of about 45° to 135°.

8. The apparatus according to claim 6 wherein each of said elastic bearing has an axis of rotation and includes an elastic insert having a hardness in a direction transverse to said axis of rotation at least twice as great as a hardness in a direction of said axis of rotation.

9. The apparatus according to claim 6 wherein said mounting means includes an arm having one end for attachment to the elevator car and an opposite end attached to one of said elastic bearings.

10. The apparatus according to claim 1 including a mounting bracket attached to said roller carrier means, said arresting device being retained by and vertically displaceable relative to said mounting bracket, whereby said mounting means maintains said roller carrier means in alignment with the running surface during twisting of the guide about the longitudinal axis to prevent an unintended engagement of said arresting device with the brake leg.

11. An apparatus for guiding elevators comprising:

an elevator car having a yoke attached thereto;

a roller carrier means for engaging running surfaces on a column-like guide for said elevator car, the running surfaces extending generally parallel to a generally vertical longitudinal axis of the guide;

a mounting means movably connected to said roller carrier means and mounted on said yoke; and an arresting device attached to said roller carrier means and being selectively engagable with a brake leg formed on the column-like guide, whereby when said mounting means is mounted on the elevator car and said roller carrier means engages the at least one running surface on the column-like guide, said mounting means permits movement of said roller carrier means relative to the elevator car along a generally circular path centered at and generally transverse to the longitudinal axis of the column-like guide to maintain said roller carrier means in alignment with the running surface during twisting of the column-like guide about the longitudinal axis and prevent an unintended engagement of said arresting device with the brake leg.

12. The elevator car according to claim 11 wherein said roller carrier means includes a central body having a pair of legs extending therefrom and an associated one of a plurality of guide rollers rotatably mounted on each of said central body and said legs for engaging running surfaces on the guide.

13. The elevator car according to claim 12 wherein said mounting means includes a generally vertically extending guide pin attached to said central body of said roller carrier means and having opposite free ends, a pair of vertically spaced apart generally horizontally extending guide plates each having an elongated slot formed therein for receiving an associated one of said free ends of said guide pin, said slots extending along said generally horizontal path and said free ends being movable in said slots, and an arm having one end attached to said yoke and an opposite end attached to said guide plates.

14. The elevator car according to claim 12 wherein said mounting means includes a pair of spaced apart elastic bearings connected between said roller carrier means and said yoke and an arm having one end attached to said yoke and an opposite end attached to one of said elastic bearings.

15. The elevator car according to claim 11 including a mounting bracket attached to said roller carrier means, said arresting device being retained by and vertically displaceable relative to said mounting bracket, whereby said mounting means maintains said roller carrier means in alignment with the running surface during twisting of the guide about the longitudinal axis to prevent an unintended engagement of the arresting device with the brake leg.

16. The elevator car according to claim 15 including an abutment attached to said yoke and a buffer attached to said abutment for engagement by said mounting bracket attached to said roller guide means.

17. An apparatus for guiding elevators comprising:

an elevator car having a yoke attached thereto;

a roller carrier means having rotatably mounted roller guides for engaging a plurality of running surfaces on a column-like guide for said elevator car, the running surfaces extending generally parallel to a generally vertical longitudinal axis of the guide;

a mounting means movably connected to said roller carrier means and mounted on said yoke whereby when said roller guides engage the running surfaces on the column-like guide for said elevator car, said mounting means permits movement of said roller carrier means relative to said elevator car along a generally circular path centered at the longitudinal axis of the column-like guide to maintain said roller guides in alignment with the running surfaces during twisting of the guide about the longitudinal axis;

an arresting device mounted on said roller carrier means and selectively engageable with the guide for stopping said elevator car, said arresting device being vertically displaceable relative to said roller carrier means; and a buffer attached to said yoke for engagement by said arresting device.

* * * * *